US005569428A

United States Patent [19]

Nolan et al.

[11] Patent Number: 5,569,428

[45] Date of Patent: Oct. 29, 1996

[54] PROCESS FOR THE PREPARATION OF FIBERS OF SYNDIOTACTIC VINYLAROMATIC POLYMERS

[75] Inventors: Stephen J. Nolan, Saginaw; Mark F. Sonnenschein, Midland; Craig J. Carriere, Midland; Brian G. Landes, Midland; Robert P. Brentin, Midland, all of Mich.

[73] Assignee: The Dow Chemical Company, Midland, Mich.

[21] Appl. No.: 403,026

[22] Filed: Mar. 13, 1995

[51] Int. Cl.[6] ..... D01D 5/16; D01F 6/22

[52] U.S. Cl. ..... 264/210.7; 264/210.8; 264/211.14

[58] Field of Search ..... 264/210.7, 210.8, 264/211.14, 290.5, 290.7

[56] References Cited

U.S. PATENT DOCUMENTS

| | | | |
|---|---|---|---|
| 4,680,353 | 7/1987 | Ishihara et al. | 526/160 |
| 5,006,296 | 4/1991 | Pedersen | 264/210.7 |
| 5,066,741 | 11/1991 | Campbell, Jr. | 526/171 |
| 5,071,917 | 12/1991 | Pederson et al. | 264/210.7 X |
| 5,206,197 | 4/1993 | Campbell, Jr. | 502/103 |
| 5,294,685 | 3/1994 | Satanabe et al. | 526/134 |

FOREIGN PATENT DOCUMENTS

| | | |
|---|---|---|
| 348829 | 1/1990 | European Pat. Off. . |
| 501352 | 9/1992 | European Pat. Off. . |
| 539596 | 5/1993 | European Pat. Off. . |

*Primary Examiner*—Leo B. Tentoni

[57] ABSTRACT

Fibers of syndiotactic vinylaromatic polymers are prepared in an improved process comprising:

A) heating the polymer to a temperature above its crystalline melting point;

B) extruding the molten polymer through a multiplicity of orifices in a spinnerette to form fibers;

C) drawing the fibers at a spin/draw ratio from 120:1 to 5000:1; and

D) cooling the fibers to ambient temperature.

8 Claims, 3 Drawing Sheets

PROCESS FOR THE PREPARATION OF FIBERS OF SYNDIOTACTIC VINYLAROMATIC POLYMERS

BACKGROUND OF THE INVENTION

The present invention relates to an improved process for the preparation of fibers of syndiotactic vinylaromatic polymers. More particularly, the present invention relates to such a process wherein the resulting fibers possess improved physical properties, particularly increased modulus, tenacity and/or maximum strain properties.

In U.S. Pat. No. 5,006,296 a process for preparing fibers of syndiotactic polystyrene (SPS) or a mixture of SPS and isotactic polystyrene was disclosed. At col. 4, lines 18–52, fibers having drawdown ratios (measured as a ratio of fiber cross-sectional area before and after drawing) from 10:1 to 100:1 were disclosed. The fibers were further disclosed as being desirably redrawn. In the redrawing step, the fiber was elongated at a ratio between 1.5:1 and 10:1. The teachings of U.S. Pat. No. 5,006,296 is hereby incorporated by reference.

Fibers prepared by the above technique possess desirable physical properties, however in many respects they lack optimum physical properties, especially tensile modulus, tenacity and/or maximum strain properties. Accordingly it would be desirable if there were provided an improved fiber spinning process for preparing fibers of syndiotactic vinylaromatic polymers having improved physical properties.

SUMMARY OF THE INVENTION

Figure 1:
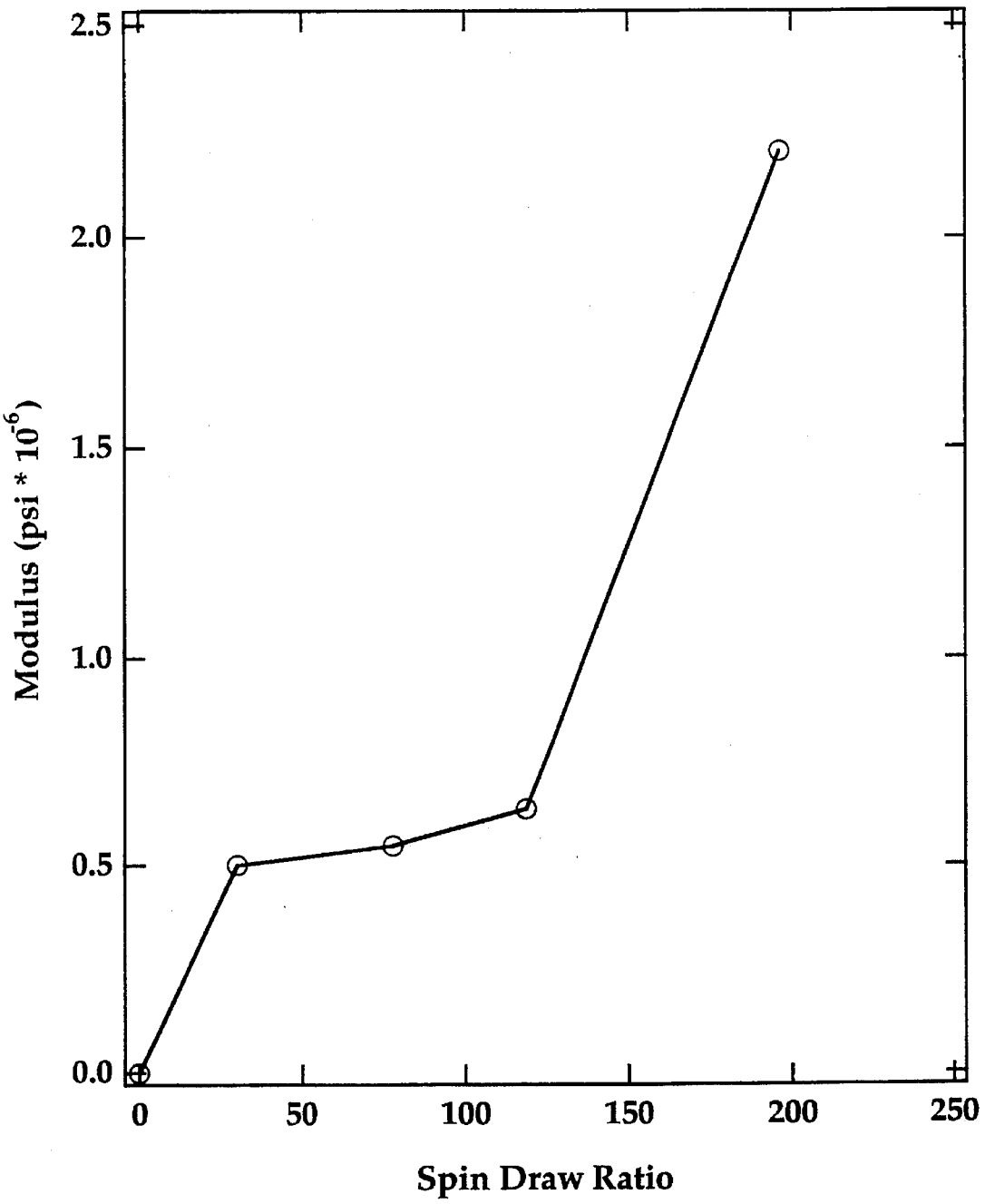
FIGS. 1–3 show the physical properties of fibers prepared in Example 4.

According to the present invention there is provided an improved process for the preparation of fibers of syndiotactic vinylaromatic polymers comprising:

A) heating the polymer to a temperature above its crystalline melting point;

B) extruding the molten polymer through a multiplicity of orifices in a spinnerette to form fibers;

C) drawing the fibers at a spin/draw ratio from 120:1 to 5000:1; and

D) cooling the fibers to ambient temperature.

The fibers prepared by the process of this invention exhibit improved modulus, tenacity, percent elongation, and/or maximum strain properties compared to fibers of syndiotactic vinylaromatic polymers prepared according to prior art fiber forming techniques. The resulting fibers are usefully employed in fabrics or cording for filtration, strengthening and reinforcement applications. They are especially useful alone or blended with other fibers in the preparation of nonwoven fabrics by spun bonded, lace bonded, wet laid, dry laid, needle punched or any alternate technique. The fabrics may ultimately be formed into useful articles such as belting or webbing for end uses requiring resistance to high temperatures and/or corrosive environments.

DETAILED DESCRIPTION

The fibers of the present invention are prepared by modification of the technique disclosed in U.S. Pat. No. 5,006,296. In the present process, higher spin/draw ratios are used in the drawing operation than have been previously disclosed in the prior art. Spin/draw ratios are equivalent to draw-down ratios of U.S. Pat. No. 5,006,296, but are more easily measured under continuous fiber spinning conditions. It has been discovered that optimum physical properties are imparted to the resulting fibers if spin/draw ratios between 120:1 and 5000:1, preferably between 130:1 and 1000:1, most preferably between 140:1 and 500:1 are employed in the drawing step during fiber formation. At such spin/draw ratios, it has been discovered that the fiber deforms in a ductile rather than a brittle manner. Among other benefits, this allows the fiber to achieve previously unattainable physical properties during a later, optional, redrawing operation. If the presently discovered spin/draw ratios are not utilized, later redrawing of the fibers does not consistently impart maximum strength properties to the fiber.

The fibers of this invention may be prepared from syndiotactic vinylaromatic homopolymers or copolymers as well as mixtures thereof. Suitable vinyl aromatic polymers include polymers of styrene, vinyltoluene (all isomers and mixtures of isomers, but preferably p-vinyltoluene), t-butylstyrene, chlorostyrene, bromostyrene, 2,5-dimethylstyrene and mixtures thereof. Preferred syndiotactic vinylaromatic polymers are polystyrene, and copolymers of styrene and p-vinyltoluene containing from 2 to 10 weight percent p-vinyltoluene. The latter copolymers have been found to attain maximum physical properties at relatively lower resin processing temperatures. Syndiotactic vinyl aromatic polymers may be prepared by methods well known in the art. Suitable procedures are disclosed in U.S. Pat. Nos. 4,680,353, 5,066,741, 5,206,197 and 5,294,685, the teachings of which are herein incorporated by reference.

As used herein, the term "syndiotactic" refers to polymers having a stereoregular structure of greater than 90 percent syndiotactic, preferably greater than 95 percent syndiotactic, of a racemic triad as determined by $^{13}C$ nuclear magnetic resonance spectroscopy. Weight average molecular weight (Mw) of the polymer is preferably from 100,000 to 500,000, more preferably from 125,000 to 400,000.

The fibers of this invention preferably have a tensile modulus (ASTM D-885) of 1,500,000 psi (114 gm/dn) or greater, preferably 3,000,000 psi (228 gm/dn) or greater, a tenacity (ASTM D-885) of 20,000 psi (1.5 gm/dn) or greater, preferably 50,000 psi (3.8 gm/dn) or greater, and a percent elongation at 50 percent of maximum load (taken when the measured load decays to 50 percent of it maximum value) of 50 percent or less, preferably 30 percent or less.

In the process of the invention the neat polymer is preferably heated to the desired extrusion temperature using an extruder and supplied in the molten state to the fiber spinning apparatus (spinnerette). Preferred extrusion temperatures for the polymer are from 250° C. to 350° C., more preferably 255° C. to 300° C. Generally, the syndiotactic copolymers of styrene and p-vinyltoluene are extruded at lower temperatures than syndiotactic polystyrene homopolymer, and are preferably used for this reason. The spinnerette head may be heated in order to maintain a uniform extrusion temperature. The molten polymer is forced through the holes of the spinnerette and desirably is quenched (cooled) in a quench zone so that the extruded fiber may be more readily drawn. Preferred is the use of an air cooled quench zone, however a liquid cooled quench zone may also be suitable for use. Tension is applied to the fibers by means of a set of godets, each comprising one or more reels, which may or may not be heated, engaging the fibers and operating at different speeds to thereby stretch the fiber. The difference in surface velocity in the godets (subsequent godets operating at higher velocities) determines the spin/draw ratio or drawdown of the fibers. That is, a spin/draw ratio of 100:1 indicates the use of a final surface velocity of the godet that is 100 times faster than the extrusion rate of the spinnerette, and consequently a fiber cross-sectional area 100 times smaller than the cross-sectional area of the fiber as extruded. After exiting the godet, the fibers are cooled to ambient temperature (less than 140° C. preferably less than 100° C.) and collected on a take-up reel or other fiber collection device or optionally subjected to redrawing.

The fibers are redrawn in order to impart further strength properties. Redrawing may be performed at temperatures less than 140° C. (cold redrawing) or performed after first reheating the fiber to a temperature from 140° to 250° C. (hot redrawing). Hot redrawing is the preferred redrawing technique. Preferred redrawing ratios are as high as 10:1, preferably from 2.0:1 to 5:1 (meaning a further reduction of cross-sectional area before and after redrawing corresponding to the stated ratio). After redrawing, the fibers are again cooled to ambient temperature and may again be collected on a take-up reel or other fiber collection device.

The skilled artisan will appreciate that the invention disclosed herein may be practiced in the absence of any component which has not been specifically disclosed. The following examples are provided as further illustration thereof and are not to be construed as limiting. Unless stated to the contrary all parts and percentages are expressed on a weight basis.

EXAMPLES

Fiber Spinning and Redrawing

Fibers were extruded using a 0.75 inch (19 mm) single screw extruder equipped with a general purpose screw. The polymer was metered by a gear pump to a 0.03 in (0.8 mm) 24 hole spinnerette employing a face heater. Discharge pressure to the spinnerette was maintained at less than 600 psi (4 MPa). The 24-filament tow was extruded across a 15 inch (38 cm) air cooled quench zone to a godet with 12 inch (30 cm) circumference rolls that were not temperature controlled. The godet had a maximum surface speed of 500 ft/min (2.5 M/sec) and no differential draw was set between the primary and secondary godet rolls. Fiber from the godet was collected on an automatic fiber winding machine. Spin/draw ratios were calculated using the following formula:

$$SDR = \frac{V_g}{(Q_p/\pi R^2 N)}$$

where $V_g$ is the surface velocity of the godet in cm/sec, $Q_p$ is the volume rate of flow to the spinnerette in $cm^3$/sec, R is the radius in cm of the holes in the spinnerette, and N is the number of holes in the spinnerette.

The fibers were hot redrawn by passing through a ceramic tube furnace to a take-up roll using a stainless steel pull rod. The feed spool was calibrated to turn at a fixed surface velocity for all experiments. The surface velocity of the take-up reel was electronically controlled to accomplish the required redraw ratios. Redraw ratios were calculated by calculating the ratio of the surface velocity of the take-up reel to the surface velocity of the feed spool.

Physical Property Testing

Fiber physical property measurements were performed using an INSTRON™ model 4201 brand tensile testing frame operating under INSTRON™ Series Nine brand software control. A 200 lb (91 Kg) load cell was used for force measurements. Experiments were run in displacement control at a cross-head speed of 1.0 inches/min (25.4 mm/min). INSTRON™ brand air actuated fiber grips were utilized to secure the samples during testing. All the experiments were conducted at 23° C. and 50 percent relative humidity.

Denier measurements were made on each sample prior to testing. Denier is defined as the weight in grams of 9000M of fiber. The denier measurement used for the present calculations was made by extrapolation using four meters of fiber. The tenacity values reported were calculated by taking the ultimate load (in grams of force) observed during the test divided by the denier of the sample. The reported tensile modulus and percent elongation values were determined at the point where the sample load had decayed, due to individual fiber failure, to 50 percent of the maximum load achieved during testing.

Example 1

A copolymer of 96 weight percent styrene and 4 weight percent p-vinyltoluene (syndiotacticity greater than 98 percent) having a molecular weight (Mw) of 285 kg/mole was spun into fibers at a melt temperature of 335° C. and a spinnerette die temperature of 290° C. with a spin draw ratio of 200. The fibers were collected then subjected to a redraw of 2.4× at 140° C. Physical properties of the redrawn fibers are provided in Table 1.

TABLE 1

| Tensile Modulus psi (g/DN) | Tenacity psi (g/DN) | Elongation (%) |
|---|---|---|
| $1.6 \times 10^6$ (122) | $2.3 \times 10^4$ (1.7) | 26 |

Example 2

A copolymer of 92 weight percent styrene and 8 weight percent p-vinyltoluene (syndiotacticity greater than 98 percent) having a molecular weight (Mw) of 255 kg/mole was spun into fibers at a melt temperature of 335° C. and a spinnerette die temperature of 285° C. with a spin draw ratio of 200. The fibers were collected then subjected to a redraw of 5× at 140° C. Physical properties of the redrawn fibers are provided in Table 2.

TABLE 2

| Tensile Modulus psi (g/DN) | Tenacity psi (g/DN) | Elongation (%) |
|---|---|---|
| $1.5 \times 10^6$ (115) | $2.0 \times 10^4$ (1.5) | 30 |

Example 3

A homopolymer of styrene (syndiotacticity greater than 98 percent) having a molecular weight (Mw) of 225 kg/mole was spun into fibers at a melt temperature of 335° C. and a spinnerette die temperature of 290° C. with a spin draw ratio of 200. The fibers were collected then subjected to a redraw of 2.5× at 180 ° C. Physical properties of the redrawn fibers are provided in Table 3.

TABLE 3

| Tensile Modulus psi (g/DN) | Tenacity psi (g/DN) | Elongation (%) |
|---|---|---|
| $3.1 \times 10^6$ (234) | $5.4 \times 10^4$ (4.1) | 8 |

Example 4

Figure 2:
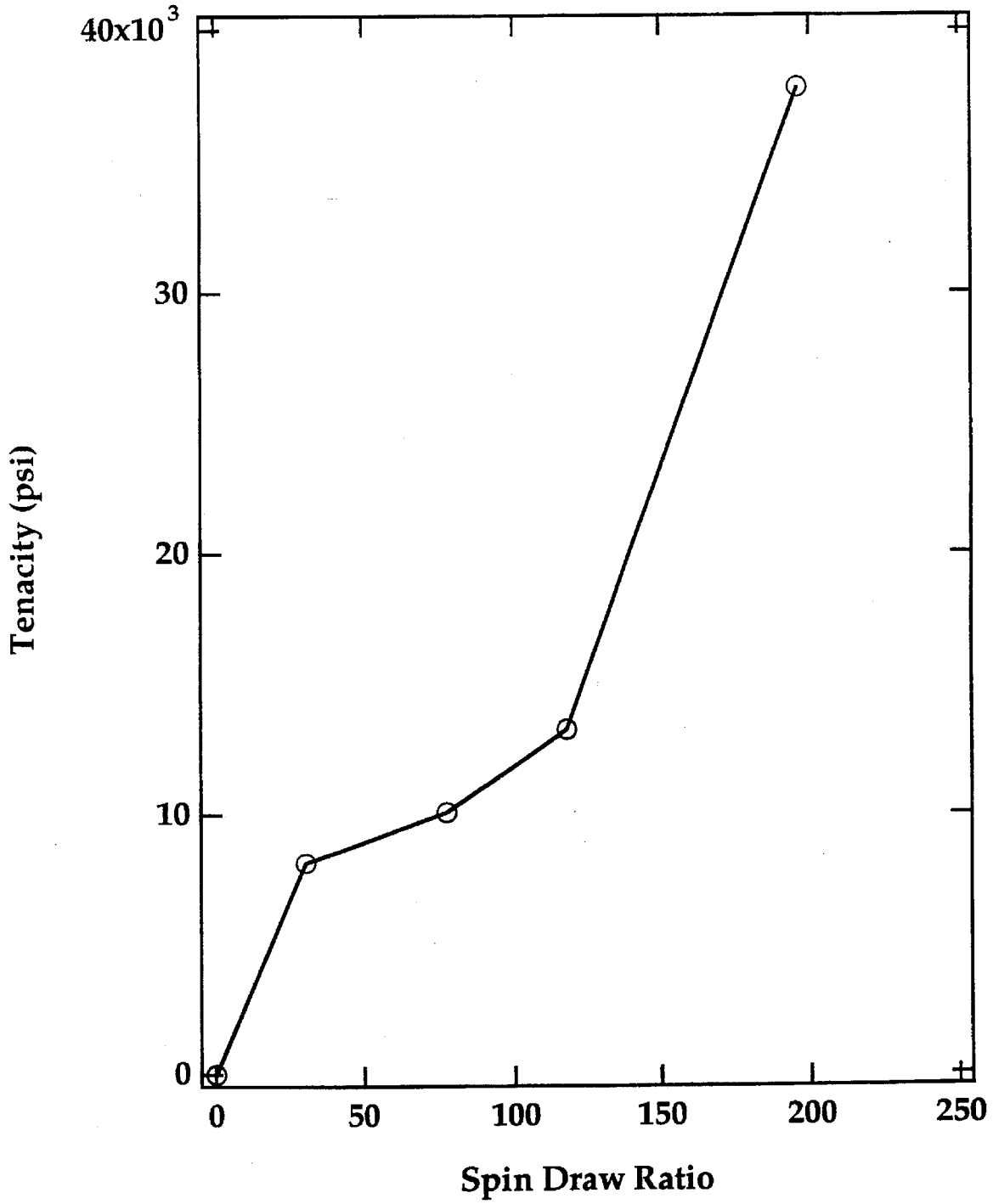
Figure 3:
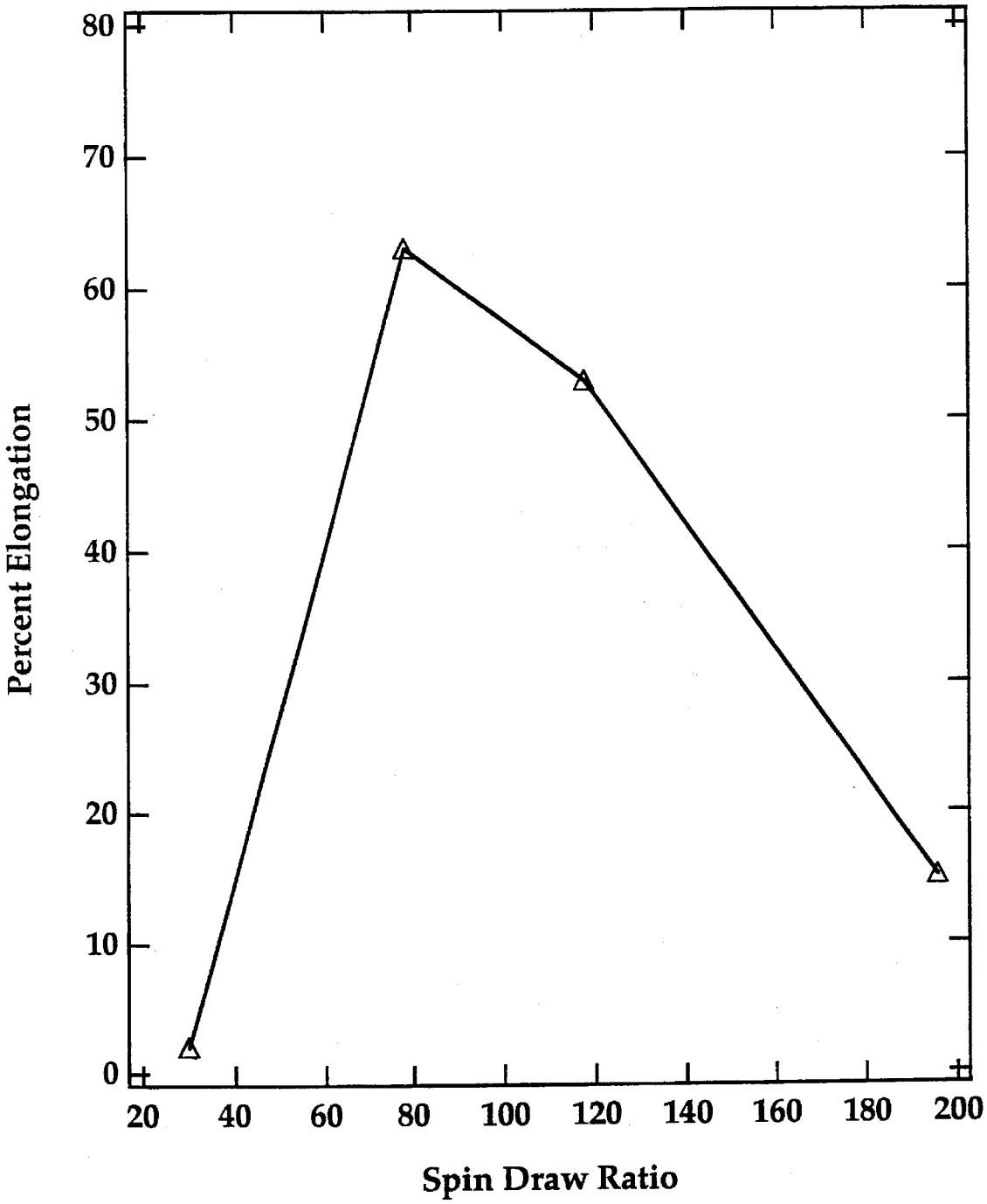

The polymer used in Example 3 was spun into fibers at an extrusion temperature of 300° C. and at various spin-draw ratios. Tensile properties of the fibers after hot redrawing (2.45×, 140° C.) are shown in FIGS. 1–3. From the figures it may be seen that fiber physical properties, especially tensile modulus, tenacity and elongation, are significantly improved by the use of spin draw ratios greater than 120:1. Specifically, the modulus and tenacity values for such fibers increased dramatically at such spin/draw ratios. Conversely, percent elongation at 50 percent strength retention was reduced, i.e. improved, for such fibers.

What is claimed is:

1. A process for the preparation of fibers of syndiotactic vinylaromatic polymers comprising:

A) heating the polymer to a temperature above its crystalline melting point;

B) extruding the molten polymer through a multiplicity of orifices in a spinnerette to form fibers;

C) drawing the fibers at a spin/draw ratio from 120:1 to 5000:1; and

D) cooling the fibers to ambient temperature.

2. A process according to claim 1 wherein the vinylaromatic polymer is a copolymer of styrene and p-vinyltoluene containing from 2 to 10 weight percent p-vinyltoluene.

3. A process according to claim 1 wherein the spin-draw ratio is from 130:1 and 1000:1.

4. A process according to claim 1 wherein the fiber is redrawn at a redraw ratio of up to 10:1.

5. A process according to claim 2 wherein the spin-draw ratio is from 130:1 and 1000:1.

6. A process according to claim 2 wherein the fiber is redrawn at a redraw ratio of up to 10:1.

7. A process according to claim 4 wherein the fiber is redrawn at a temperature from 140° C. to 250° C.

8. A process according to claim 6 wherein the fiber is redrawn at a temperature from 140° C. to 250° C.

* * * * *